US006480685B2

(12) United States Patent
Jones et al.

(10) Patent No.: US 6,480,685 B2
(45) Date of Patent: Nov. 12, 2002

(54) SYSTEM AND METHOD FOR QUIETLY AND EFFICIENTLY CLEANING AND REMOVING PARTICLES FROM A COPIER/PRINTER MACHINE

(75) Inventors: Kurt E. Jones, Webster; James D. Anthony, Victor; Eric C. Stelter, Pittsford, all of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/734,396

(22) Filed: Dec. 11, 2000

(65) Prior Publication Data

US 2002/0071691 A1 Jun. 13, 2002

(51) Int. Cl.[7] ..... G03G 21/00
(52) U.S. Cl. ..... 399/98; 399/99

(58) Field of Search ..... 399/92, 93, 98, 399/99

(56) References Cited

U.S. PATENT DOCUMENTS

| | | | | |
|---|---|---|---|---|
| 4,724,459 A | | 2/1988 | Ford | |
| 5,028,959 A | * | 7/1991 | Gooray | 399/93 |
| 5,424,806 A | * | 6/1995 | Siegel | 399/92 X |
| 5,521,690 A | * | 5/1996 | Taffler et al. | 399/93 |
| 5,862,439 A | * | 1/1999 | Pozzanghera | 399/98 |
| 5,899,600 A | | 5/1999 | Hockey | |

* cited by examiner

*Primary Examiner*—William J. Royer

(57) ABSTRACT

A method and system for cleaning and removing particles from a printer machine quietly and efficiently with a variable speed blower whereby the blower can operate in a reduced power mode during normal operation and in an increased power mode for special cleaning operations in the printer machine.

23 Claims, 4 Drawing Sheets

SYSTEM AND METHOD FOR QUIETLY AND EFFICIENTLY CLEANING AND REMOVING PARTICLES FROM A COPIER/PRINTER MACHINE

FIELD OF THE INVENTION

This invention relates to a dual level performance cleaning system for removing particles from a copier/printer machine during normal operation and operations requiring a higher vacuum level for the desired cleaning.

BACKGROUND OF THE INVENTION

In high volume copier/printer machine processes that implement particles for development, such as a dry toner, it is necessary to remove waste products, including excess toner from certain areas of the machine. Vacuum cleaning is often implemented with a particle separator that separates waste particles from a cleaning gas flow. The vacuum system can include a high wattage blower, a cyclone separator, hoses and various other toner and developer removal hardware, as well as hoses and the like associated with a vacuum system for manually cleaning the inside of the copier/printer machine. The vacuum levels needed to provide adequate airflow can require the blower requirements to exceed one kilowatt. The use of a blower of this size results in undesirable levels of noise, excessive power consumption, and higher equipment costs. Accordingly, an improved system and method has been sought to accomplish the desired cleaning and particle removal more quietly and efficiently.

SUMMARY OF THE INVENTION

According to the present invention, a method for quietly and efficiently cleaning and removing particles from a copier/printer machine by positioning a variable speed blower in fluid communication with a vacuum system adapted to draw a gaseous stream from the copier/printer during normal operations and during heavy duty operations; adjusting the blower speed to provide a first lower vacuum sufficient for normal operations during normal operations and increasing the blower speed to provide an increased vacuum sufficient for heavy duty cleaning operations during heavy duty cleaning operations.

DESCRIPTION OF PREFERRED EMBODIMENTS

Various aspects of the invention are presented in FIGS. 1–4, which are not drawn to scale and wherein like components in the numerous views are numbered like. The various components presented and described with reference to the Figures may be altered or subsitituted with other types of components suitable for use within an electrographic cleaning process, as may be desired for a particular application, without departing from the invention. It is not intended to limit the invention to the specific embodiments presented herein, as they are representative of the inventive concepts defined by the claims appended hereto.

Figure 1:
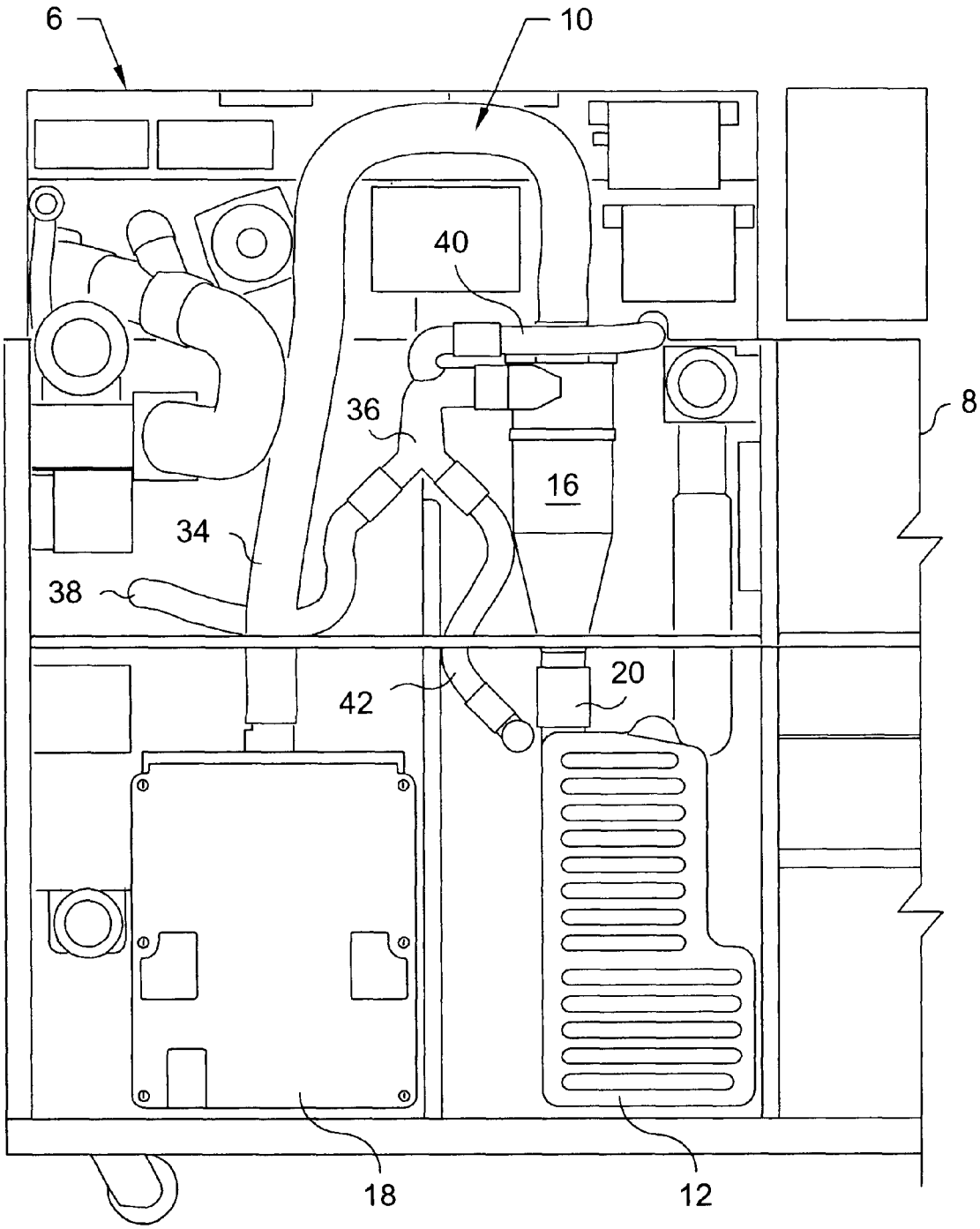
FIG. 1 presents a view of an electrographic marking engine, with parts broken away, having a cleaning system according to an aspect of the invention.

Referring now specifically to FIG. 1, an electrographic process cleaning system 10 is presented of the type configured to have a particle collection container 12. A vacuum is imposed upon the cleaning system 10, by a vacuum source or blower 18 for driving the flow of cleaning gas throughout the cleaning system 10.

Although not limited to a particular electrographic process, the invention is particularly useful in an electrographic process that implements a photoconductive film loop and dry toner development, also known as electrophotography. While the exemplary electrographic process cleaning system 10 presented in FIG. 1 is configured in a manner suitable for cleaning dry electrographic toner and paper particles in a film loop electrographic process, it is not intended to limit the invention in such manner. The cleaning system 10 is part of an electrographic marking engine 6, of which only a portion is shown, broken away at line 8.

The cleaning system 10 comprises a particle separator 16 in fluid communication with the particle collection container 12 via a conduit 20. The vacuum source 18 is in fluid communication with the particle separator 16 via a vacuum supply conduit 34. The particle separator 16 is also in fluid communication with a junction or manifold 36 which, in turn, is in fluid communication with a film loop cleaning station (not shown) via a first conduit 38, a transfer roller cleaning station (not shown) via a second conduit 40, and a toning station dust collector (not shown) via a third conduit 42. The vacuum source 18 available from Ametek Division of Rotron, Kent, Ohio, U.S.A. and the particle separator 16 configured as a cyclone separator of the type described in U.S. Pat. Nos. 4,724,459 and 5,899,600 are suitable for application in the present invention. The vacuum draws waste particles from the film loop cleaning station, transfer roller cleaning station, and the toning station dust collector through the conduits 38, 40 and 42, through the manifold 36, and into the particle separator 16 where the particles are separated from the flow and drop into the particle collection container 12. The vacuum source 18 draws the cleaned flow out of the particle separator 16 through conduit 34. The structure of the film loop cleaning station, transfer roller cleaning station, and toning station dust collector are known in the art. Such apparatus is provided in the Digimaster® 9110 brand digital high volume printer manufactured by Heidelberg Digital L. L. C. of Rochester, N.Y.

Figure 2:
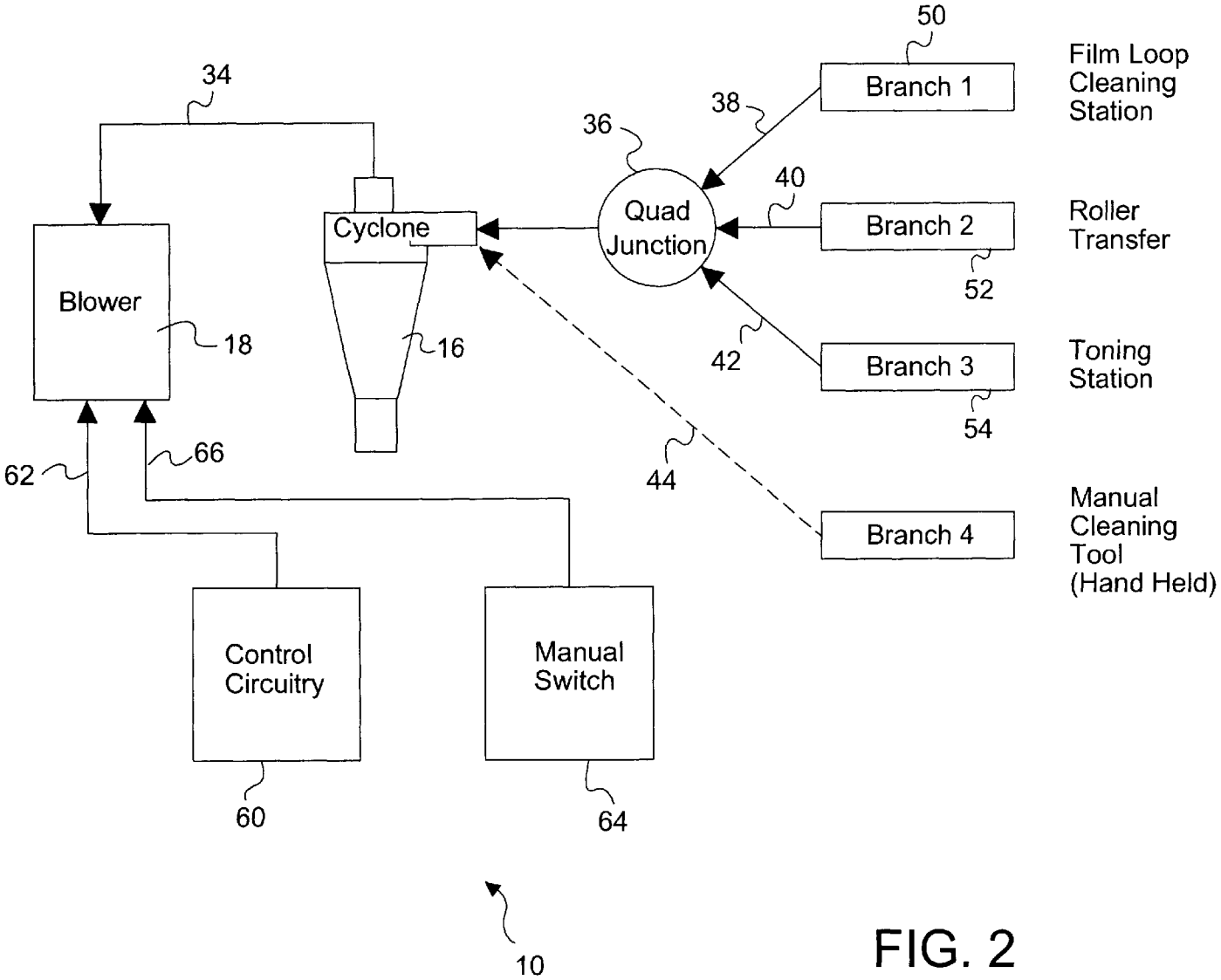
FIG. 2 is a schematic diagram of a variable speed blower system for a print engine.

Referring now to FIG. 2, wherein like reference numerals designate like or corresponding parts to the embodiment shown in FIG. 1, a blower cleaning system 10 for a print engine includes a blower 18, a separator 16, a junction or manifold 36 and inlet or feed lines 38, 40, 42, all of which are in fluid communication with one another. The blower is used to generate a vacuum by withdrawing, via line 34, a cleaned gaseous stream from the outlet of the separator. As used herein, the term "vacuum pressure" means a pressure less than ambient pressure outside the cleaning system 10. As a result, a vacuum suction is created in the inlet lines to the separator. Inlet lines 38, 40, 42 put the separator in fluid communication with various areas of the print engine. During operation of the print engine, the blower removes excess toner from certain areas of the print engine. Examples of areas being cleaned are the film loop cleaning station 50, the transfer roller cleaning station 52, and the toning station dust collector 54.

The blower may be operated in different modes, by controlling the speed thereof to thereby control the vacuum level. For exemplary purposes, three modes will be described herein, although other speeds and modes are contemplated as being within the purview of the present invention. A first exemplary mode is a run or normal mode (lower vacuum). A second exemplary mode of operation is a special cleaning or heavy duty cleaning mode (higher vacuum). What is meant by heavy duty cleaning is that waste particles are removed that otherwise wouldn't be removed during normal operation or running of the machine.

In the normal, or run mode, the blower operates at a relatively low speed to produce a desired vacuum for cleaning operations during normal operations of the print engine. The noise from the blower is at a correspondingly low level and the power consumption by the blower is at a low level. The cleaning during the normal operating mode is achieved by the use of suction from selected location or locations (described above) in the copier/printer machine to remove airborne aerosols or particles which may come into the vicinity of the suction inlets from a brush cleaner for a photoconductor film and the like. These gaseous streams are drawn via the suction from the cyclone separator inlet into the cyclone separator where the gaseous stream is introduced generally tangentially into the cyclone separator. The operation of the cyclone separator will be discussed in greater detail hereinafter.

In a second mode or cleaning mode, the speed of the blower is increased in order to increase the vacuum to collect excess particles not previously collected during normal operation. To this end, the manifold 36 may be disconnected from the separator 16 and a cleaning hose 44 (shown as a dotted line) may be connected so that an operator can vacuum out areas other than the stations 50, 52, 54 cleaned during normal operation. Other attachments can be provided to allow the use of the suction from the inlet to the cyclone separator. For instance, a hand held cleaning tool (shown only in schematic form) or the like can be used for cleaning or removal of particles from areas of the machine not reached during other operations. Alternatively, manifold 36 may also be configured as a diverter (not shown), so that during normal operation only lines 38, 40, 42 would be in fluid communication with the separator and during the cleaning mode, only hose 44 would be in fluid communication with the separator. A diverter would thereby eliminate the need to connect and disconnect hose 44 when changing modes.

In a third exemplary mode or operation, during and after abrupt shutdowns of the print engine, untransferred toner may remain on the conductor film and may be present in the machine in increased quantities. Abrupt shutdowns may be caused by many conditions, such as paper jams, fuser roller overheating, subsystem malfunctions and the like. The term paper jam is used to refer to any difficulty in the paper handling system which results in a machine shutdown requiring the removal of paper, paper pieces or the like. It is desirable that a higher vacuum be used to remove the toner and insure a higher flow of air into the suction inlets from the machine and the like immediately after abrupt shutdown. Higher suction used for heavier duty cleaning applications may be used to ensure a higher flow rate of a gaseous stream into the inlets to the vacuum system for a selected period of time such as up to five minutes after an abrupt shutdown has been cleared in order to remove excessive waste particles. The time period is not critical and may be shortened or lengthened if desired.

In the prior use of such systems, the blower has been operated at a steady speed during both normal and heavier duty cleaning. Less vacuum is required for normal leaning operations. The vacuum for such operations may be on the order of 30 inches of water or less. This vacuum is sufficient to draw a gaseous stream from the copier/printer machine at a velocity sufficient to carry particulate solids which are airborne in gaseous streams in the machine. It is unnecessary to run the blower at a higher speed since the higher speed creates more vacuum than required for normal operations and requires more power and produces more noise. By contrast, heavier duty cleaning is required for the removal of heavy particles such as: developer or the like; manual cleaning or the use of a much higher gaseous stream flow through the normal cleaning system; or perhaps an alternate cleaning system for a period of time after an abrupt shutdown. In such instances increased quantities of particles are possible in the machine as a result of clearing the paper jam or the like.

It is to be noted that in order to maximize the efficiency of the blower, it is beneficial to minimize the total impedance (manifested by pressure drop) of the vacuum system as seen by the blower. Methods to lower impedance are well know to those skilled in the art.

Blower 18 is controlled through embedded software in the machine logic control unit or another controller. A box 60 represents the control circuitry which provides electrical control of the blower via a line 62. Additionally, the blower can be placed in the higher speed cleaning mode via a manual switch 64 through a control line 66.

Figure 3:
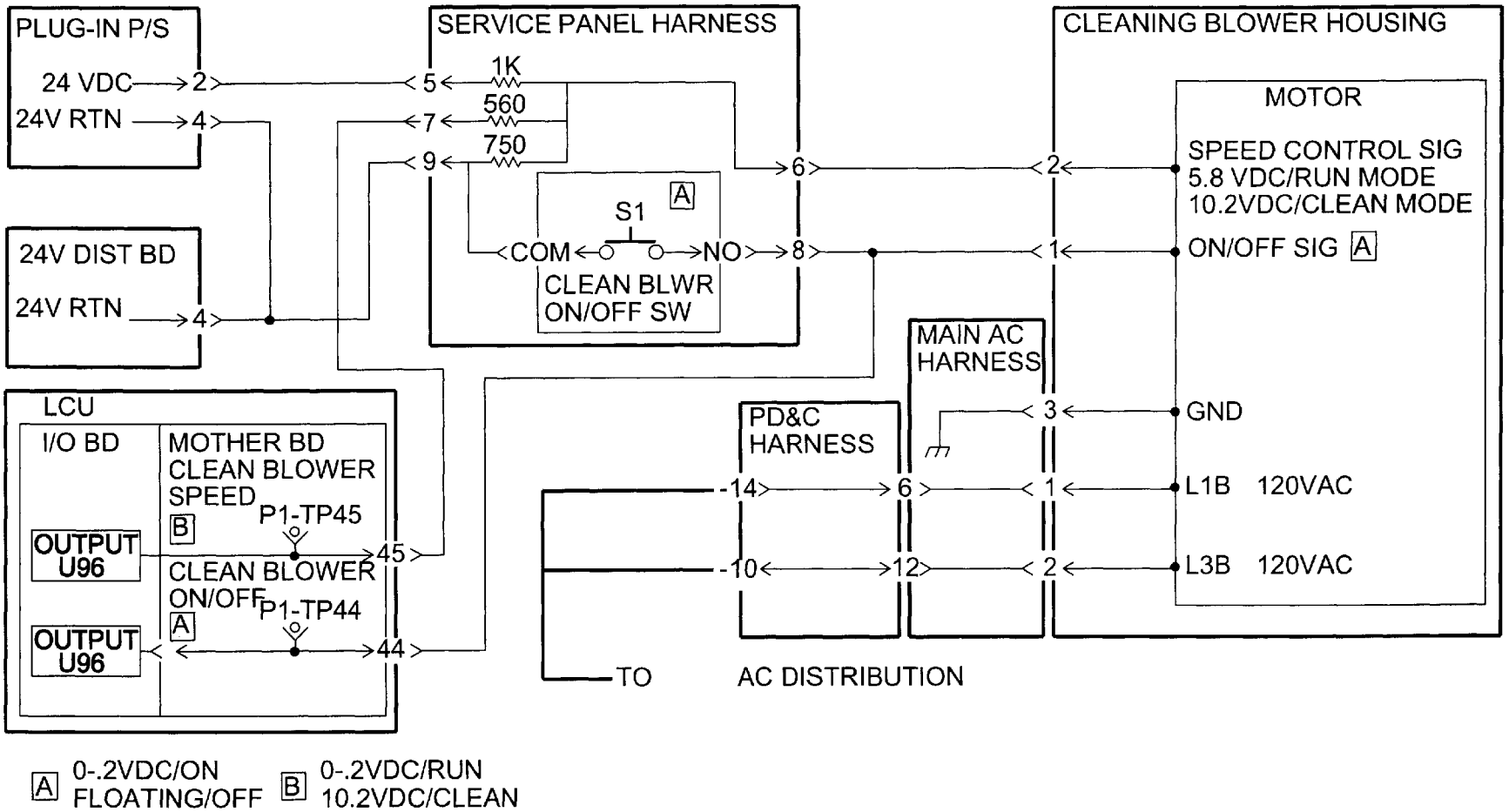
FIG. 3 is a schematic diagram of electrical control for a variable speed blower system for a print engine.

Referring now to FIG. 3, a representative control circuit diagram for a variable speed blower is shown. In FIG. 3 the cleaning blower housing houses the motor and provides a chamber for the vacuum system.

The motor cleaning blower is powered with 240 volts AC through the AC distribution system of the print engine. This blower provides for the necessary air flow (vacuum) for cleaning the film during copying operations and for cleaning the developer station/machine. The motor on/off signal control and speed control signals are applied to the motor input as indicated by the associated circuitry. The changes in the blower control signals to effectuate changes in blower speed are made by either a logic control unit (LCU) or a manual clean switch (S1). LCU may be a programmable controller having a microprocessor and associated circuitry. Controllers of this type are well known to those skilled in the art.

The plug-in power supply provides the 24 volts D.C. that is used to develop the controlled voltages. This power supply is always on even when the printer main power switch is off.

The 24 volts distribution D.C. provides a common return path for all controlled voltages.

Resistors (1KΩ, 560Ω, 750Ω) are utilized to develop the proper control voltage for normal operation when making copies and for the cleaning operation. The switch S1 can be used to manually turn the blower on even if the LCU is still active.

The LCU provides a return path to that part of the circuit when the output port turns on.

During normal operation of making copies, both LCU output ports turn on. The clean blower speed output port places a 560 ohm resistor in parallel with a 750 ohm resistor to provide a correct voltage provider to produce a 5.8 V.D.C. voltage that is sent to the motor speed control signal input of the motor. This voltage causes the motor to run at a reduced speed providing the low vacuum required for proper cleaning of the film. The clean blower on/off output port provides a return path or a low signal to the motor's on/off signal input to enable the motor to run. When the output port is off, the motor will not run. If the printer's main power switch is turned off, both output ports would be off because the LCU would not be active. This removes the 560 ohm resistor from the voltage divider and the motor speed control signal voltage becomes approximately 10.2 V.D.C. This voltage causes the motor to operate at full speed. To clean manually the operator or repair person would have to place the vacuum switch to the "clean" position that is located on the front panel of a power distribution and control panel (PD&C). This circumvents the printer's main contactor and provides the motor with 240 VAC. The operator or repair person would manually actuate the S1 switch that would enable the motor and therefore cleaning could be performed.

If the main power is "on", then by going into the input/output software screen this condition could be created by turning off the clean blower speed output port and turning on the clean blower on/off output port.

Figure 4:
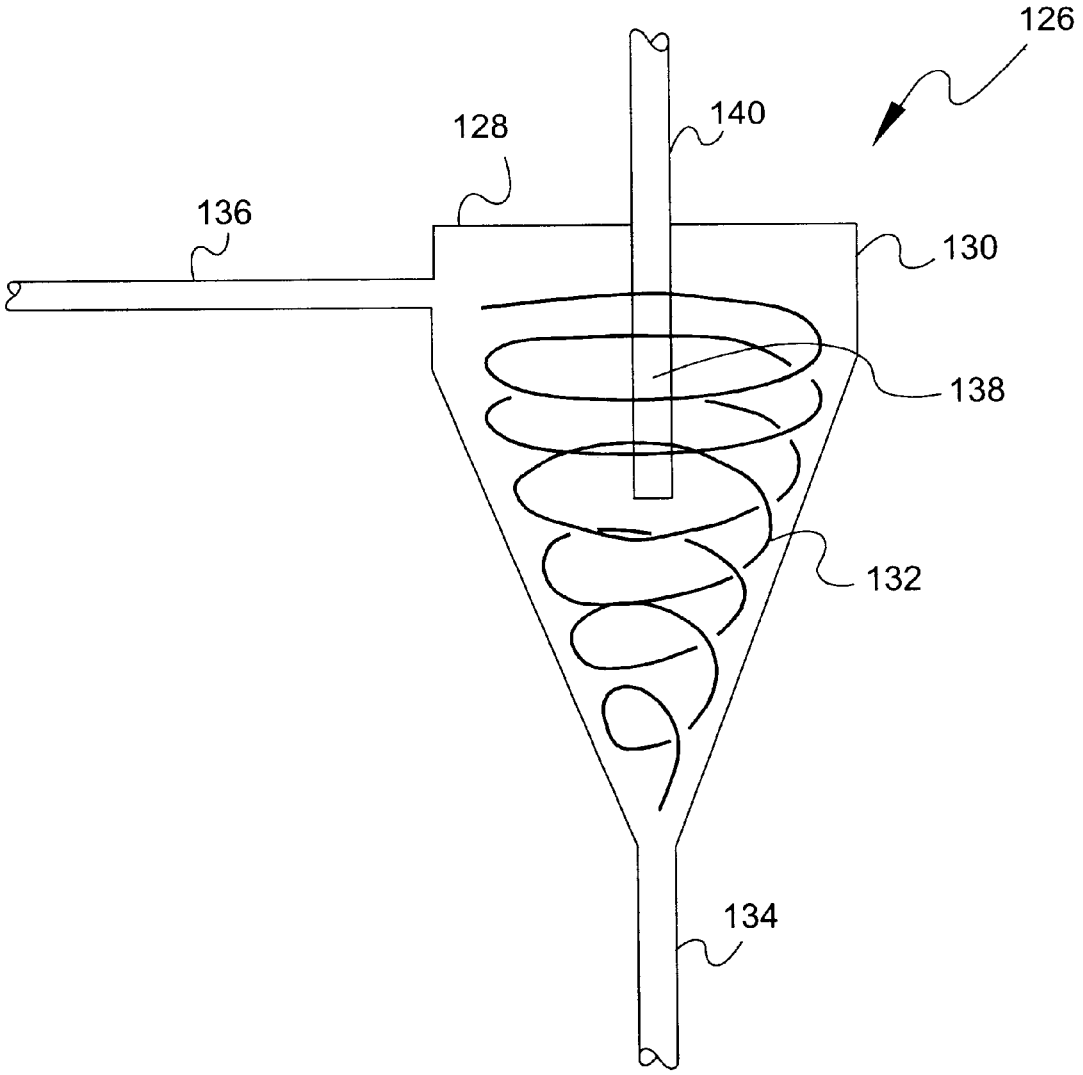
FIG. 4 is a schematic diagram of a cyclone separator for a blower system for a print engine.

Referring now to FIG. 4, a representative cyclone separator 126 is shown. Cyclone separator 126 comprises a body 128, which comprises a generally cylindrical upper portion 130 with a conical section 132 leading to a particles discharge section 134. While the cyclone separator is shown in a vertical position, it can be positioned in other orientations if desired. Generally, the particles recovered through discharge section 134 are collected in a suitable container or the like. An inlet gaseous stream containing particulate solids is charged to cyclone separator 126 via a line 136. Desirably this stream is injected tangentially into cyclone separator 126. The heavier particles are moved by centrifugal force from the gaseous stream to the outside of the conical section and toward discharge section 134. A vortex finder 138 is centrally positioned to remove a clean gaseous stream from a central portion of cyclone separator 126 in an area in which the solids have been separated by centrifugal force and moved to the outside of cyclone separator 126. The vortex finder is in fluid communication with the blower via a line 140. Such separations are considered to be well known to those skilled in the art. The operation of blowers and cyclone separators is also considered to be well known to those skilled in the art.

When it is desired to remove developer/toner or to clean the inside of the machine or for any other applications which require higher suction, the suction can be increased by increasing the control voltage to the blower as required to increase the vacuum to approximately 60 inches of water or higher if required. This permits the use of a smaller blower, using less power consumption during normal operations and reduced noise. The improvement of the present invention still provides high suction to remove gaseous streams which contain large quantities of particles which may be relatively dense particles. It further permits the use of a higher suction when it is necessary for use to clean the machine, provide a higher suction after paper jams and the like.

According to the present invention, a reduced equipment cost is achieved by the reduced power consumption during normal operations and the noise is reduced as a result of the lower speed blower operation. This is achieved by the use of a variable speed blower which can provide both the higher suction required for more strenuous cleaning requirements and the reduced suction required for normal operation at reduced power and more quiet normal operation.

According to the present invention, the efficiency of the cleaning operation has been increased by using the power levels necessary to provide the desired suction for the cleaning operation. Even though lower power levels have been used for cleaning operations during normal operation of the copier/printer machine, the claimed system also provides increased suction as necessary for heavier cleaning applications. The present invention has thus provided for increased efficiency and quieter operation while still achieving heavier duty cleaning when required.

Having thus described the invention by reference to certain of its preferred embodiments, it is pointed out that the embodiments described are illustrative rather than limiting in nature and that many variations and modifications are possible within the scope of the present invention.

Having thus described the invention, we claim:

1. A method for removing particles from selected areas of a printer comprising the steps of:

a) providing a blower to create a vacuum to draw particles from selected areas of the printer;

b) controlling the blower to provide a first vacuum level during normal printer operations; and, c) controlling the blower to provide a second vacuum level during special cleaning operations.

2. The method of claim 1 wherein the special cleaning comprises drawing particles from at least one location in the printer for a selected period of time after an abrupt shutdown in the printer.

3. The method of claim 2, wherein the abrupt shutdown is caused by a paper jam.

4. The method of claim 1 wherein the special cleaning comprises drawing particles through a hand held cleaning tool.

5. The method of claim 1, wherein the first vacuum level is lower than the second vacuum level.

6. An apparatus for removing particles from selected areas of a printer comprising:

a) a blower to create a vacuum to draw particles from selected areas of the printer;

b) a control system to control the blower to provide a first vacuum level during normal printer operations; and a second vacuum level during special cleaning operations.

7. An apparatus in accordance with claim 6, wherein the special cleaning comprises drawing particles from at least one location in the printer for a selected period of time after an abrupt shutdown in the printer.

8. An apparatus in accordance with claim 7, wherein the abrupt shutdown is caused by a paper jam.

9. An apparatus in accordance with claim 6 wherein the special cleaning comprises drawing particles through a hand held cleaning tool.

10. An apparatus in accordance with claim 6, wherein the first vacuum level is lower than the second vacuum level.

11. A. system for cleaning and removing particles from a printer comprising:

a) a separator having an inlet, a cleaned gaseous stream outlet and a particles outlet, the separator being adapted to separate particles from a gaseous stream containing particles passed into the separator to produce a cleaned gaseous stream, the cleaned gaseous stream being recovered via the cleaned gaseous stream outlet, with particles being recovered via the particles outlet;

b) a blower operable at varied speeds, in fluid communication with the separator cleaned gaseous stream outlet to withdraw the clean gaseous stream therefrom and create a vacuum suction at the separator inlet;

c) a controller for control the blower at selected varied power levels;

d) a vacuum system adapted to perform at least one of the functions of: drawing a gaseous stream containing particles from at least one location in the printer during normal operation into the separator inlet; drawing a gaseous stream from at least one location in the printer at a high rate during special cleaning from selected areas of the printer and into the separator; and, e) a switch adapted to select at least one of a first vacuum level supplied to the blower at a normal operation level and a second increased vacuum level during the special cleaning.

12. The system of claim 11 wherein the gaseous stream containing particles is drawn from a plurality of locations in the printer during normal operation.

13. The system of claim 11 wherein the gaseous stream containing a high concentration of particles contains developer particles.

14. The system of claim 11, further comprising a cleaning tool comprising a manually operated cleaning tool in fluid communication with the inlet to the separator.

15. The system of claim 11 wherein the switch comprises software adapted to select a power level responsive to a signal indicative of the desired function of the vacuum system.

16. The system of claim 11 wherein the switch comprises a manual on/off switch for special cleaning.

17. The system of claim 11 wherein the blower wattage is less than about one (1) kilowatt during normal operation.

18. A method for removing particles from a printer machine, the method comprising the steps of:

a) positioning a separator in the printer machine, the separator having an inlet, a cleaned gaseous stream outlet and a particles outlet, the separator being adapted to separate particles from a gaseous stream containing particles passed into the separator to produce a cleaned gaseous stream, the cleaned gaseous stream being recovered via the cleaned gaseous stream outlet, with particles being recovered via the particles outlet, the separator being in fluid communication with a vacuum system adapted to perform at least one of the functions of drawing a gaseous stream containing particles from at least one location in the printer machine during normal operation into the separator inlet; drawing a gaseous stream from at least one location in the printer machine at a high rate for special cleaning;

b) providing a blower operable at varied speeds, in fluid communication with the separator cleaned gaseous stream outlet to withdraw the clean gaseous stream therefrom and create a vacuum suction at the separator inlet;

c) operating the blower at a relatively low speed during normal operation; and, d) increasing the blower speed during at least one of the removal of particles during special cleaning.

19. The method of claim 18 wherein the gaseous stream containing particles is drawn from a plurality of locations in the printer machine during normal operation.

20. The method of claim 18 wherein the gaseous stream containing a high concentration of particles results from an abrupt stop of the printer machine.

21. A method for cleaning and removing particles from a printer machine, the method comprising the steps of:

a) positioning a separator, having an inlet and a clean gaseous stream outlet, in the printer machine in fluid communication with a vacuum system and adapted to perform at least one of the functions of drawing a gaseous stream containing particles from at least one location in the printer machine during normal operation into the separator inlet; drawing a gaseous stream containing particles from at least one location in the printer machine at a high rate during a special cleaning mode and into the separator;

b) a blower operable in fluid communication with the separator clean gaseous stream outlet to withdraw the clean gaseous stream from the separator and create a vacuum suction at the separator inlet; and, c) controlling the blower to operate in both normal and special cleaning modes.

22. A method in accordance with claim 21 wherein special cleaning modes comprise at least one of drawing a gaseous stream containing particles through a cleaning tool.

23. A method in accordance with claim 21 wherein special cleaning modes comprise at least one of drawing a gaseous stream containing particles at a higher vacuum after an abrupt stop of the printer machine.

* * * * *